US007850473B1

(12) United States Patent
Ozeki

(10) Patent No.: US 7,850,473 B1
(45) Date of Patent: Dec. 14, 2010

(54) ELECTRICAL CONNECTOR

(75) Inventor: Kosuke Ozeki, Tokyo (JP)

(73) Assignee: I-Pex Co., Ltd. (JP)

( * ) Notice: Subject to any disclaimer, the term of this patent is extended or adjusted under 35 U.S.C. 154(b) by 0 days.

(21) Appl. No.: 12/791,515

(22) Filed: Jun. 1, 2010

(30) Foreign Application Priority Data

Aug. 10, 2009 (JP) ..... 2009-185601

(51) Int. Cl.
*H01R 13/15* (2006.01)

(52) U.S. Cl. ..... 439/260

(58) Field of Classification Search ..... 439/269, 439/329

See application file for complete search history.

(56) References Cited

U.S. PATENT DOCUMENTS 6,315,616 B1 * 11/2001 Hayashi ..... 439/638
7,001,208 B2 * 2/2006 Huang ..... 439/260
7,150,634 B2 * 12/2006 Kamata et al. ..... 439/95
2003/0176111 A1 * 9/2003 Iida et al. ..... 439/660
2004/0248447 A1 * 12/2004 Aoki ..... 439/260
2009/0023324 A1 * 1/2009 Koike et al. ..... 439/492

FOREIGN PATENT DOCUMENTS

JP 2008-052993 A 3/2008
JP 2008-192574 A 8/2008

* cited by examiner

*Primary Examiner*—Briggitte R Hammond
(74) *Attorney, Agent, or Firm*—Studebaker & Brackett PC; Donald R. Studebaker

(57) ABSTRACT

An electrical connector including a housing provided with an opening through which a flat circuit device is inserted into the housing, a plurality of conductive contacts arranged on the housing, a conductive shell mounted on the housing for covering partially the same and provided with a holding member for engaging with the flat circuit device inserted in the housing to hold the same, and a releasing member formed in the housing with a first end portion thereof operative to be in contact with the holding member and a second end portion thereof operative to project from the inside to the outside of the conductive shell, wherein the releasing member is moved so that the first end portion thereof causes the holding member to be released from engagement with the flat circuit device inserted in the housing when the second end portion thereof is pushed toward the inside of the conductive shell under a condition wherein the holding member is put in the engagement with the flat circuit device inserted in the housing.

10 Claims, 10 Drawing Sheets

ELECTRICAL CONNECTOR

BACKGROUND OF THE INVENTION

1. Field of the Invention

The present invention relates generally to an electrical connector, and more particularly to an improvement in an electrical connector which has a housing, a plurality of conductive contacts arranged in the housing for coming into press-contact with connecting terminals provided on a flat circuit device, such as a flexible printed circuit board (hereinafter, referred to as an FPC) or a flexible flat cable assembly (hereinafter, referred to as an FFC) inserted in the housing, so as to put the flat circuit device in electrical connection with another electrical device, such as a main solid circuit board, and holding means for engaging with the flat circuit device inserted in the housing so as to hold the same to be prevented from getting out of the housing unwillingly.

2. Description of the Prior Art

A flat circuit device, such as a relatively small-sized FPC or FFC, used in electronic apparatus of various kinds is often mounted on a main solid circuit board, on which various electrical parts are directly mounted, with an electrical connector which is fixed to and connected electrically with the main solid circuit board. The electrical connector has a plurality of conductive contacts, an end portion of each of which is connected electrically with a conductive circuit pattern portion formed on the main solid circuit board and which are provided for coming into contact with connecting terminals provided on the flat circuit device, and is operative to connect electrically, through the conductive contacts, each of the connecting terminals provided on the flat circuit device with the conductive circuit pattern portion formed on the main solid circuit board.

A first type of previously proposed electrical connector used for mounting a flat circuit device, such as an FPC, on a main solid circuit board, is provided with a housing made of insulator, which is fixed on the main solid circuit board and has an opening through which at least a part of the flat circuit device is inserted into the housing. In the housing, a plurality of conductive contacts are provided to be arranged along the opening and connected electrically with circuit terminals provided on the main solid circuit board. These conductive contacts are operative to come into contact respectively with a plurality of connecting terminals provided on the flat circuit device when the flat circuit device is inserted into the housing through the opening provided thereon. The previously proposed electrical connector of the first type is also provided with a conductive shell which covers partially the housing and is grounded to be operative to contribute to adjustment on characteristic impedance of each of the conductive contacts and to shield the conductive contacts in the housing from electromagnetic wave noises coming from the outside. The previously proposed electrical connector of the first type is further provided with an actuator which is provided to be rotatable in regard to the housing so as to engage with each of the conductive contacts arranged in the housing. When the actuator is rotated in a first direction in regard to the housing, an operating portion of each of the conductive contacts is moved by the actuator to put the conductive contact in press-contact with a corresponding one of the connecting terminals provided on the flat circuit device, and then, when the actuator is rotated in a second direction opposite to the first direction in regard to the housing, the conductive contacts put in press-contact with the connecting terminals provided on the flat circuit device are released from the press-contact with the connecting terminals. With the conductive contacts put in press-contact with the connecting terminals provided on the flat circuit device, the flat circuit device is put in electrical connection with the main solid circuit board.

A second type of previously proposed electrical connector used for mounting the flat circuit device on the main solid circuit board is provided with a housing fixed on the main solid circuit board, a plurality of conductive contacts and a conductive shell in such a manner as mentioned above but is not provided with an actuator rotatable in regard to the housing. In the previously proposed electrical connector of the second type, when the flat circuit device is inserted into the housing through an opening provided thereon, each of the conductive contacts provided in the housing to be arranged along the opening is automatically put in press-contact with a corresponding one of connecting terminals provided on the flat circuit device. That is, the flat circuit device is put in electrical connection with the main solid circuit board by means of only inserting correctly the flat circuit device into the housing through the opening provided thereon.

In the above-mentioned previously proposed electrical connector with or without the actuator rotatable in regard to the housing, when the flat circuit device is inserted into the housing through the opening provided thereon and the conductive contacts provided in the housing are put in press-contact with the connecting terminals provided on the flat circuit device so that the flat circuit device is put in electrical connection with the main solid circuit board, it is required to prevent the flat circuit device inserted in the housing from getting out of the housing unwillingly. It is a matter of course that it is necessary for the flat circuit device inserted in the housing to be held stably so as not to get out of the housing unwillingly in order to keep the conductive contacts provided in the housing properly in a condition of press-contact with the connecting terminals provided on the flat circuit device.

There has been also proposed previously an electrical connector belonging to the above-described first type having the housing, the conductive contact, the conductive shell and the actuator, which is provided with holding means for engaging with a flat circuit device, such as an FPC or FFC, inserted in the housing so as to hold the same to be prevented from getting out of the housing unwillingly, as shown in, for example, the Japanese patent application published before examination under publication number 2008-52993 (hereinafter, referred to as published patent document 1).

In addition, there has been further proposed previously an electrical connector belonging to the above-described second type having the housing, the conductive contact and the conductive shell, which is provided with holding means for engaging with a flat circuit device, such as an FPC or FFC, inserted in the housing so as to hold the same to be prevented from getting out of the housing unwillingly, as shown in, for example, the Japanese patent application published before examination under publication number 2008-192574 (hereinafter, referred to as published patent document 2).

In the electrical connector shown in the published patent document 1, the holding means (a locking portion 11*c*) is formed in a part of the conductive shell (a shield plate 11) to be able to seesaw with an engaging end portion (a nail portion 11*d*) curved to the inside of the conductive shell. The holding means shifts its position in response to a movement of the actuator (an actuator 9) provided to be rotatable in regard to the housing (a housing 3).

Then, when the actuator is rotated in a first direction in regard to the housing after the flat circuit device (an FPC 21) is inserted into a receiving space (an FPC receiving space 34) provided in the housing, each of the conductive contacts (first contacts 5, second contacts 6) provided in the housing is caused to shift its position by a cam (a cam portion 92 or 93) formed on the actuator so as to be put in press-contact with a corresponding one of connecting terminals provided on the flat circuit device inserted in the housing and the holding means is caused to shift its position by a com (a cam portion 94) formed on the actuator so as to cause the engaging end portion of the holding means to engage with an engaging portion (a recess 21*a*) formed on the flat circuit device. As a result, the flat circuit device inserted in the housing is prevented from getting out of the housing unwillingly.

After that, when the actuator is rotated in a second direction opposite to the first direction in regard to the housing under a condition wherein the engaging end portion of the holding means engages with the engaging portion formed on the flat circuit device, the cam (the cam portion 94) formed on the actuator allows the holding means to release the engaging end portion of the holding means from the engagement with the engaging portion formed on the flat circuit device. As a result, the flat circuit device is put in a condition to be able to get out of the housing.

Further, in the electrical connector shown in the published patent document 2, the conductive shell (a shell 4) is provided to be rotatable to the housing (a housing body 2) and the holding means (a leg portion 46) in the form of a leaf spring is formed in a part of the conductive shell. The holding means has an engaging projection (44) formed at an end of the holding means to be curved to the inside of the conductive shell.

When the flat circuit device (an FPC) is inserted into the housing through the opening (an opening 21) provided thereon under a condition wherein the conductive shell is positioned to keep lying down on the housing so as to be close in its entirety to the housing, each of the conductive contacts (upper contacts 31, lower contacts 32) provided in the housing is caused to be put in press-contact with a corresponding one of connecting terminals provided on the flat circuit device inserted in the housing and the engaging projection formed on the holding means is caused to engage with an engaging portion (an FPC engaging hole 2) provided on the flat circuit device. As a result, the flat circuit device inserted in the housing is prevented from getting out of the housing unwillingly.

After that, when the conductive shell is rotated to be positioned to keep rising from the housing under a condition wherein the engaging projection formed on the holding means is put in engagement with the engaging portion formed on the flat circuit device, the holding means formed in the conductive shell shifts its position in response to a movement of the conductive shell so as to release the engaging projection provided on the holding means from the engagement with the engaging portion formed on the flat circuit device. As a result, the flat circuit device is put in a condition to be able to get out of the housing.

In each of the electrical connectors thus proposed previously, which is provided with the holding means operative to prevent the flat circuit device inserted in the housing from getting out of the housing unwillingly, the holding means, which is put in operation to prevent the flat circuit device inserted in the housing from getting out of the housing unwillingly, is provided to be operative to shift its position in response to rotational movements of the actuator provided to be rotatable in regard to the housing or the conductive shell for covering partially the housing is provided to be rotatable in regard to the housing and the holding means, which is put in operation to prevent the flat circuit device inserted in the housing from getting out of the housing unwillingly, is formed in a part of the conductive shell.

In the case of the previously proposed electrical connector which has the holding means operative to shift its position in response to the rotational movements of the actuator provided to be rotatable in regard to the housing, the actuator provided to be rotatable in regard to the housing is required and this results in problems or disadvantages that the number of constitutive parts of the electrical connector increases undesirably and a production cost of the electrical connector rises disagreeably.

Further, it is necessary for causing the holding means to engage with or disengage from the flat circuit device inserted in the housing to rotate the actuator in regard to the housing and this results in undesirable increase in an open space around the electrical connector. Besides, since the conductive shell is shaped to cover only an upper surface of the housing opposite to a lower surface of the same facing the main solid circuit board and side surfaces of the housing opposite each other in the direction along which the conductive contacts are arranged, a contribution by the conductive shell to the adjustment on characteristic impedance of each of the conductive contacts is inevitably reduced and a shielding effect by the conductive shell to the conductive contacts against the electromagnetic wave noises can not be obtained sufficiently.

Further, in the case of the previously proposed electrical connector which has the conductive shell provided to be rotatable in regard to the housing and the holding means formed in the part of the conductive shell, since the conductive shell is operative to rotate in regard to the housing, any part of the conductive shell can not be used for fastening the electrical connector to the main solid circuit board so that a separate holding-down member for fastening the electrical connector to the main solid circuit board is required and this results in problems or disadvantages that the number of constitutive parts of the electrical connector increases undesirably and a production cost of the electrical connector rises disagreeably. In addition, in this case also, since the conductive shell provided to be rotatable in regard to the housing is shaped to cover only an upper surface of the housing opposite to a lower surface of the same facing the main solid circuit board and side surfaces of the housing opposite each other in the direction along which the conductive contacts are arranged, a contribution by the conductive shell to the adjustment on characteristic impedance of each of the conductive contacts is inevitably reduced and a shielding effect by the conductive shell to the conductive contacts against the electromagnetic wave noises can not be obtained sufficiently.

OBJECTS AND SUMMARY OF THE INVENTION

Accordingly, it is an object of the present invention to provide an electrical connector used for mounting a flat circuit device, such as an FPC or FFC, on a solid circuit board, which comprises a housing made of insulator and provided with an opening through which a flat circuit device is inserted into the housing, a plurality of conductive contacts provided to be arranged on the housing, and a conductive shell covering partially the housing, and which avoids the aforementioned disadvantages encountered with the prior art.

Another object of the present invention is to provide an electrical connector used for mounting a flat circuit device, such as an FPC or FFC, on a solid circuit board, which comprises a housing made of insulator and provided with an opening through which a flat circuit device is inserted into the housing, a plurality of conductive contacts provided to be arranged on the housing, and a conductive shell covering partially the housing, and in which the flat circuit device inserted in the housing can be surely put in holding to be prevented from getting out of the housing unwillingly and then released from the holding so as to be able to get out of the housing with a relatively small number of constitutive parts of the electrical connector resulting in a reduced production cost of the electronic connector.

A further object of the present invention is to provide an electrical connector used for mounting a flat circuit device, such as an FPC or FFC, on a solid circuit board, which comprises a housing made of insulator and provided with an opening through which a flat circuit device is inserted into the housing, a plurality of conductive contacts provided to be arranged on the housing, and a conductive shell covering partially the housing, and in which the flat circuit device inserted in the housing can be surely put in holding to be prevented from getting out of the housing unwillingly and then released from the holding so as to be able to get out of the housing without an actuator provided to be rotatable in regard to the housing and without setting the conductive shell to be rotatable in regard to the housing.

A still further object of the present invention is to provide an electrical connector used for mounting a flat circuit device, such as an FPC or FFC, on a solid circuit board, which comprises a housing made of insulator and provided with an opening through which a flat circuit device is inserted into the housing, a plurality of conductive contacts provided to be arranged on the housing, and a conductive shell covering partially the housing, and in which the flat circuit device inserted in the housing can be surely put in holding to be prevented from getting out of the housing unwillingly and then released from the holding so as to be able to get out of the housing under a condition wherein the conductive shell is operative to contribute effectively to adjustment on characteristic impedance of each of the conductive contacts and to shield sufficiently the conductive contacts in the housing from electromagnetic wave noises from the outside.

According to the present invention, as claimed in any one of claims, there is provided an electrical connector, which comprises a housing made of insulator to be mounted on a solid circuit board and provided thereon with an opening through which a flat circuit device, such as an FPC or FFC, is inserted into the housing, a plurality of conductive contacts arranged on the housing to be electrically connected respectively with circuit terminals provided on the solid circuit board and positioned to correspond respectively to connecting terminals provided on the flat circuit device when the flat circuit device is inserted in the housing through the opening provided thereon, a conductive shell mounted on the housing to cover a major part of the same and to be electrically connected with a grounded portion provided on the solid circuit board and provided with a holding member formed in a body therein to extend into the housing for engaging with the flat circuit device inserted in the housing to hold the same, and a releasing member formed in a body in the housing to be movable with a first end portion thereof operative to be in contact with the holding member and a second end portion thereof operative to project from the inside to the outside of the conductive shell on the side of a first end surface of the housing opposite to a second end surface of the housing which faces the solid circuit board, wherein the releasing member is moved so that the first end portion of the releasing member causes the holding member to be released from engagement with the flat circuit device inserted in the housing when the second end portion of the releasing member is pushed toward the inside of the conductive shell under a condition wherein the holding member is put in engagement with the flat circuit device to hold the same in the housing.

Especially, in a first example of electronic connector according to the present invention, such as claimed in claim 3, the holding member is provided with an engaging portion for engaging with an engaging edged portion provided on the flat circuit device inserted in the housing to hold the flat circuit device in the housing and a resilient arm portion for supporting the engaging portion to be shiftable in its position in the housing. In the first example, when the second end portion of the releasing member is pushed toward the inside of the conductive shell under a condition wherein the first end portion of the releasing member is in contact with the resilient arm portion of the holding member and the engaging portion of the holding member is put in engagement with the engaging edged portion provided on the flat circuit device inserted in the housing, the first end portion of the releasing member deforms resiliently the resilient arm portion of the holding member to shift the engaging portion of the holding member in its position so that the engaging portion of the holding member is released from the engagement with the engaging edged portion provided on the flat circuit device inserted in the housing.

Further, in a second example of electronic connector according to the present invention, such as claimed in claim 6, the holding member is also provided with an engaging portion for engaging with an engaging edged portion provided on the flat circuit device inserted in the housing to hold the flat circuit device in the housing and a resilient arm portion for supporting the engaging portion to be shiftable in its position in the housing in the same manner as the first example. In the second example, an end portion of the engaging portion of the holding member on the side of the opening provided on the housing through which the flat circuit device is inserted into the housing is positioned in close vicinity to a port of the housing in which the opening is formed.

In the electrical connector thus constituted in accordance with the present invention, when the flat circuit device is inserted into the housing thorough the opening provided thereon, each of the conductive contacts provided to be arranged in the housing comes into press-contact with the corresponding one of the connecting terminals provided on the flat circuit device inserted in the housing and the holding member formed in the conductive shell engages with the flat circuit device inserted in the housing to hold the same. As a result, the flat circuit device inserted in the housing is prevented from getting out of the housing unwillingly.

Then, when the second end portion of the releasing member is pushed toward the inside of the conductive shell under the condition wherein the holding member is put in engagement with the flat circuit device inserted in the housing to hold the same, the first end portion of the releasing member is in contact with the holding member and the second end terminal has projected from the inside to the outside of the conductive shell, the releasing member is moved so that the holding member is released from engagement with the flat circuit device by the first end portion of the releasing member. As a result, the flat circuit device inserted in the housing is put in a condition to be able to get out of the housing.

The holding member employed, for example, in each of the first and second examples of electrical connector as mentioned above has the engaging portion for engaging with the engaging edged portion provided on the flat circuit device inserted in the housing to hold the flat circuit device in the housing and the resilient arm portion for supporting the engaging portion to be shiftable in its position in the housing. The first end portion of the releasing member is in contact with the resilient arm portion of the holding member.

The engaging portion of the holding employed, for example, in the second example of electrical connector as mentioned above has the end portion thereof positioned in close vicinity to the port of the housing in which the opening through which the flat circuit device is inserted into the housing is formed.

Accordingly, in the each of the first and second examples of electrical connector as mentioned above, when the flat circuit device is inserted into the housing through the opening provided thereon, the engaging portion of the holding member engages automatically with the engaging edged portion provided on the flat circuit device inserted in the housing to hold the flat circuit device in the housing, so that the flat circuit device is prevented from getting out of the housing unwillingly.

After that, when the second end portion of the releasing member is pushed toward the inside of the conductive shell under the condition wherein the engaging portion of the holding member is put in engagement with the engaging edged portion provided on the flat circuit device inserted in the housing to hold the flat circuit board, the first end portion of the releasing member deforms resiliently the resilient arm portion of the holding member to shift the engaging portion of the holding member in its position and thereby the engaging portion of the holding member is released from the engagement with the engaging edged portion provided on the flat circuit device inserted in the housing, so that the flat circuit device inserted in the housing is put in a condition to be able to get out of the housing.

With the electrical connector thus constituted in accordance with the present invention, as described above, it is not required, for causing the holding member formed in the conductive shell to be put in engagement with the flat circuit device inserted in the housing to hold the same and then to be released by the releasing member provided in the housing from the engagement with the flat circuit device to put the same in free, to provide on the housing an actuator rotatable in regard to the housing or to set the conductive shell to be rotatable in regard to the housing. Accordingly, the conductive shell fixed to the housing can be used for fastening the housing to the solid circuit board and any additional member for fastening the housing to the solid circuit board is not required. As a result, the electrical connector according to the present invention can be constituted with a relatively small number of constitutive parts and at a production cost reduced effectively.

In the electrical connector according to the present invention, since the holding member is automatically put in engagement with the flat circuit device to hold the same in the housing when the flat circuit device is inserted into the housing through the opening provided thereon and then the holding member is released from the engagement with the flat circuit device inserted in the housing when the second end portion of the releasing member, which projects from the inside to the outside of the conductive shell on the side of the first end surface of the housing opposite to the second end surface of the housing facing the solid circuit board, is pushed toward the inside of the conductive shell, the holding member can be released from the engagement with the flat circuit device inserted in the housing by extremely simple and easy operations and it is not necessary for carrying out such operations to provide an undesirable open space around the releasing member.

Further, since the conductive shell provided with the holding member formed therein is mounted on the housing to cover a major part of the same and connected electrically with the grounded portion provided on the solid circuit board, the conductive shell can be operative to contribute effectively to the adjustment on the characteristic impedance of each of the conductive contacts and to shield sufficiently the conductive contacts in the housing from electromagnetic wave noises from the outside.

Especially, in the first example of electrical connector according to the present invention, since the first end portion of the releasing member deforms resiliently the resilient arm portion of the holding member to shift the engaging portion of the holding member in its position so that the engaging portion of the holding member is released from the engagement with the engaging edged portion provided on the flat circuit device inserted in the housing when the second end portion of the releasing member is pushed toward the inside of the conductive shell under the condition wherein the engaging portion of the holding member supported to be shiftable in its position by the resilient arm portion of the holding member is put in engagement with the engaging edged portion provided on the flat circuit device inserted in the housing, the flat circuit device inserted in the housing can be easily put in holding by the holding member and then surely released from the holding by the holding member.

Besides, in the second example of electrical connector according to the present invention, when the flat circuit device inserted in the housing is pulled in a direction from the inside to the outside of the housing under the condition wherein the engaging portion of the holding member supported to be shiftable in its position by the resilient arm portion of the holding member is put in engagement with the engaging edged portion provided on the flat circuit device to hold the same and thereby the engaging edged portion provided on the flat circuit device pushes the engaging portion of the holding member toward the opening provided on the housing through which the flat circuit device is inserted in the housing, the end portion of the engaging portion of the holding member on the side of the opening provided on the housing comes into press-contact with the port of the housing in which the opening is formed and thereby the engaging portion of the holding member pushed by the engaging portion of the holding member is stopped by the port of the housing in which the opening is formed. As a result, the engaging portion of the holding member pushed by the engaging edged portion of the flat circuit device does not exert substantially any harmful force to the resilient arm portion of the holding member supporting the engaging portion, so that the resilient arm portion of the holding member is prevented from deforming undesirably.

The above, and other objects, features and advantages of the present invention will become apparent from the following detailed description taken in conjunction with the accompanying drawings.

BRIEF DESCRIPTION OF THE DRAWINGS

FIG. 3 is a schematic front view showing the embodiment shown in

FIG. 1;

DESCRIPTION OF THE PREFERRED EMBODIMENT

Figure 1:
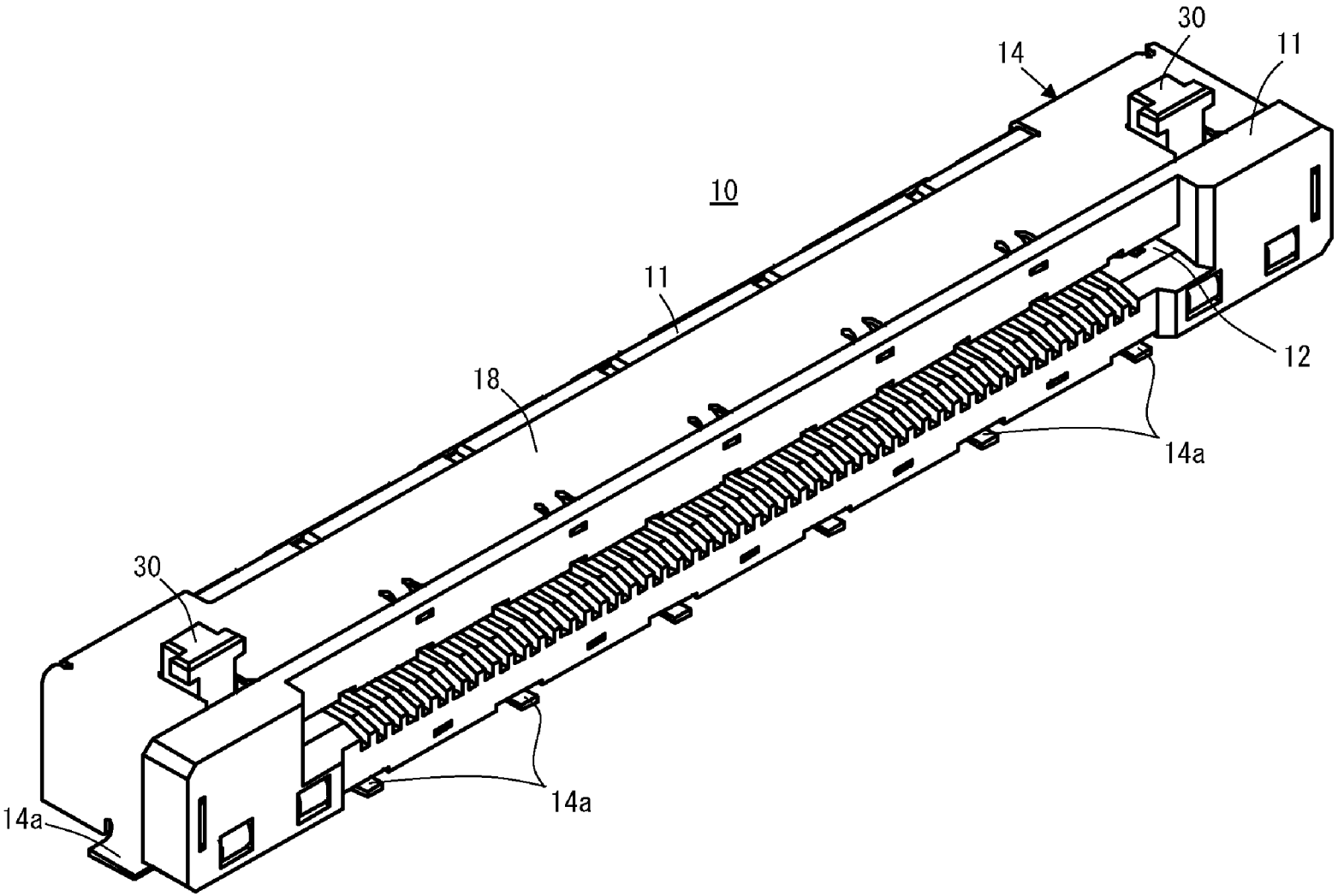
FIG. 1 is a schematic front, top and left side perspective view showing an embodiment of electrical connector according to the present invention.
Figure 2:
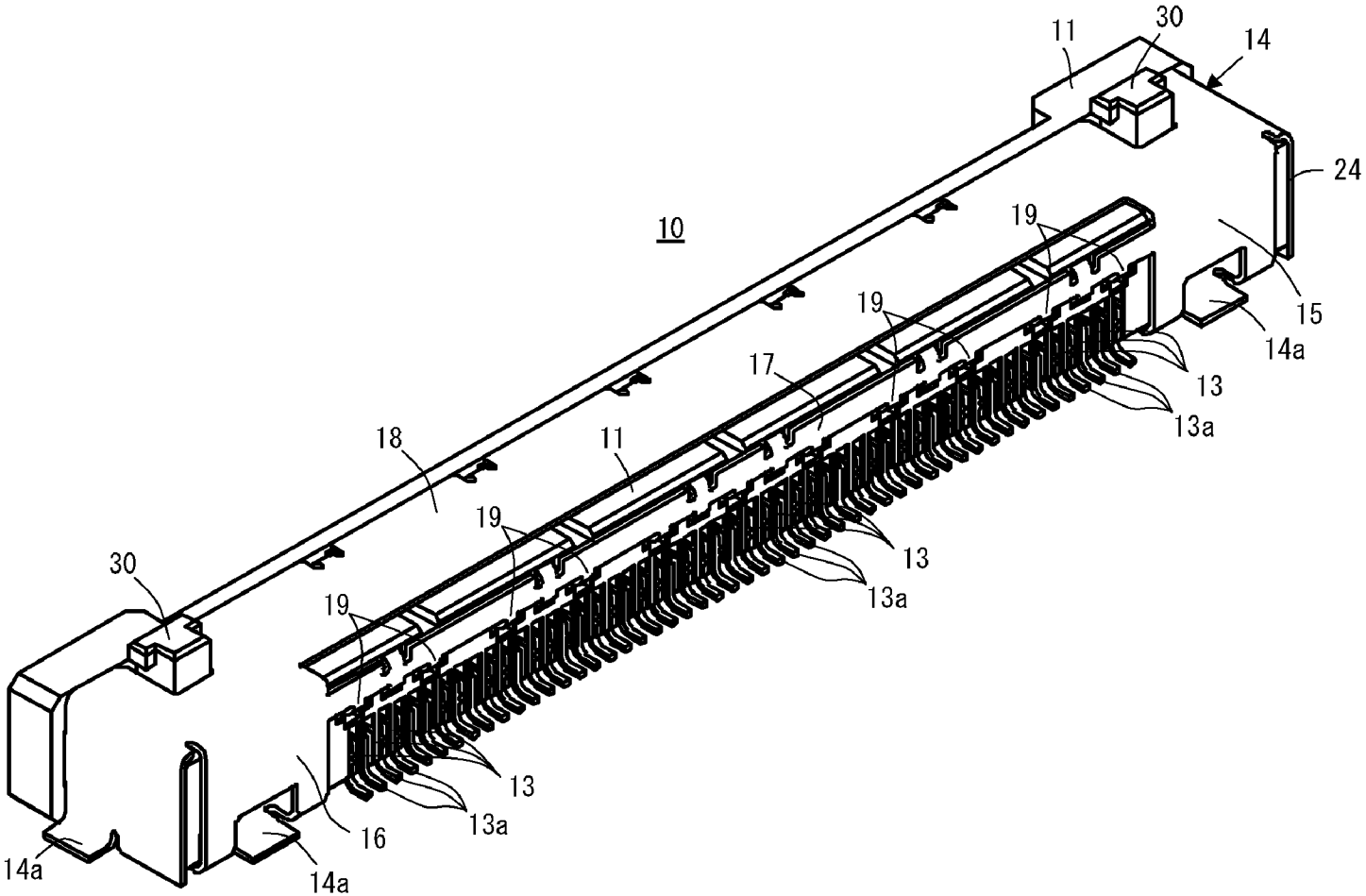
FIG. 2 is a schematic rear, top and left side perspective view showing the embodiment shown in FIG. 1.
Figure 3:
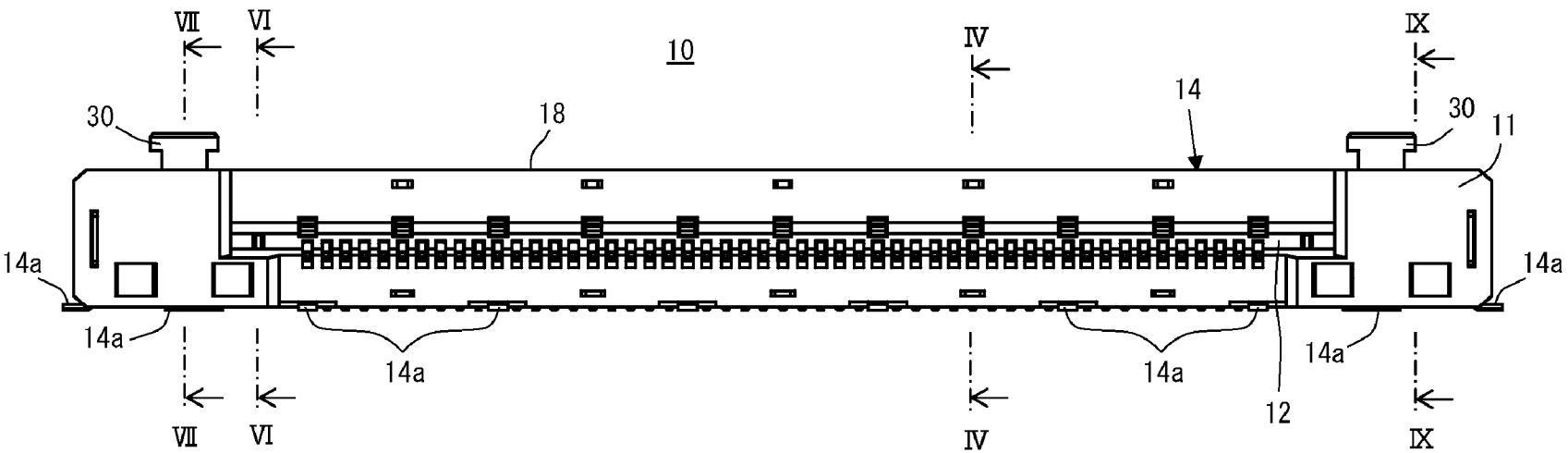

Each of FIG. 1 which is a schematic front, top and left side perspective view, FIG. 2 which is a schematic rear, top and left side perspective view and FIG. 3 which is a front view, shows an embodiment of electrical connector according to the present invention.

Referring to FIGS. 1 to 3, an electrical connector 10, which constitutes the embodiment of electrical connector according to the present invention, has a housing 11 made of insulator, such as plastics or the like. The housing 11 is provided in a front end portion thereof with an opening 12 through which a flat circuit device, such as an FPC, is inserted into the housing 11 and a room extending in the housing 11 from the opening 12 for accommodating the flat circuit device inserted in the housing 11.

When the electrical connector 10 is put in practical use for mounting, for example, an FPC constituting the flat circuit device on a solid circuit board in an electronic apparatus (not shown in the drawings), the housing 11 is mounted on the solid circuit board so that the electrical connector 10 is fixed in its entirety to the solid circuit board. The housing 11 mounted on the solid circuit board has a first end surface which is an outer surface of an upper end portion of the housing 11 and open to a space on the solid circuit board and a second end surface which is an outer surface of a lower end portion of the housing 11 and opposite to the first surface to face the solid circuit board.

A plurality of conductive contacts 13, each of which is made of resilient conductive material, are provided on the housing 11 to be arranged in a longitudinal direction of the housing 11. The conductive contacts 13 are operative to be electrically connected respectively with connecting terminals provided on the FPC inserted in the housing 11. To be more concrete, each of the conductive contacts 13 constitutes one of a signal contact, a ground contact and a power supply contact which are electrically connected respectively with a signal connecting terminal, a ground connecting terminal and a power source connecting terminal provide on the FPC inserted in the housing 11.

Further, each of the conductive contact 13 has a connecting terminal portion 13*a* projecting from a rear end portion of the housing 11 to the outside thereof, as shown in FIG. 2. The connecting terminal portion 13*a* of the conductive contact 13 is connected electrically with one of circuit terminals provided on the solid circuit board on which the housing 11 is mounted. These conductive contacts 13 are, for example, thrust into the housing 11 from the rear end portion thereof shown in FIG. 2 when the electrical connector 10 is assembled.

When the FPC is inserted into the housing 11 through the opening 12 provided thereon, the conductive contacts 13 come into press-contact with the connecting terminals provided on the FPC inserted in the housing 11, respectively. Therefore, the connecting terminals provided on the FPC inserted in the housing 11 are electrically connected through the conductive contacts 13 with the circuit terminals provided on the solid circuit board on which the housing 11 is mounted.

The electrical connector 10 has also a conductive shell 14 mounted on the housing 11 for covering a major part of the housing 11 except the front end portion of the housing 11 in which the opening 12 is formed. To be more concrete, the conductive shell 14 covers a large part of outer surfaces of the upper end portion, the lower end portion, a left side end portion, a right side end portion and the rear end portion of the housing 11.

The conductive shell 14 is formed by means of processing a metal thin plate and grounded to be operative to contribute to adjustment on the characteristic impedance of each of the conductive contacts 13 on the housing 11 and to shield the conductive contacts 13 on the housing 11 from electromagnetic wave noises coming from the outside.

As shown in FIG. 2, the conductive shell 14 does not cover the front end portion, portions surrounding the front end portion, a part of a portion between the upper end portion and the rear end portion and a part of the rear end portion, from which the connecting terminal portion 13*a* of each of the conductive contacts 13 extends to the outside of the housing 11, but covers a major part of the upper end portion, the left side end portion and the right side end portion. Further, the conductive shell 14 is provided with a plurality of ground connecting portions 14*a*, each of which is operative to be connected electrically by, for example, soldering with grounded portions provided on the solid circuit board on which the housing 11 is mounted.

Since the conductive shell 14 covers the major part of the upper end portion, the left side end portion and the right side end portion and each of the ground connecting portions 14*a* provided on the conductive shell 14 is connected electrically by, for example, soldering with a grounded portion provided on the solid circuit board on which the housing 11 is mounted, as described above, a distance from the conductive shell 14 to each of the conductive contacts 13 is set to be relatively short so that the conductive shell 14 is operative to contribute effectively to the adjustment on the characteristic impedance of each of the conductive contacts 13 and the conductive contacts 13 are sufficiently shielded by the conductive shell 14 from the electromagnetic wave noises coming from the outside. In addition, the conductive shell 14 is able to be used for fastening the housing 11 to the solid circuit board on which the housing 11 is mounted. The adjustment on the characteristic impedance of each of the conductive contacts 13 means adjustment on design for coordinating the characteristic impedance of each of the conductive contacts 13 to the characteristic impedance of each of the connecting terminals provide on the FPC.

Figure 4:
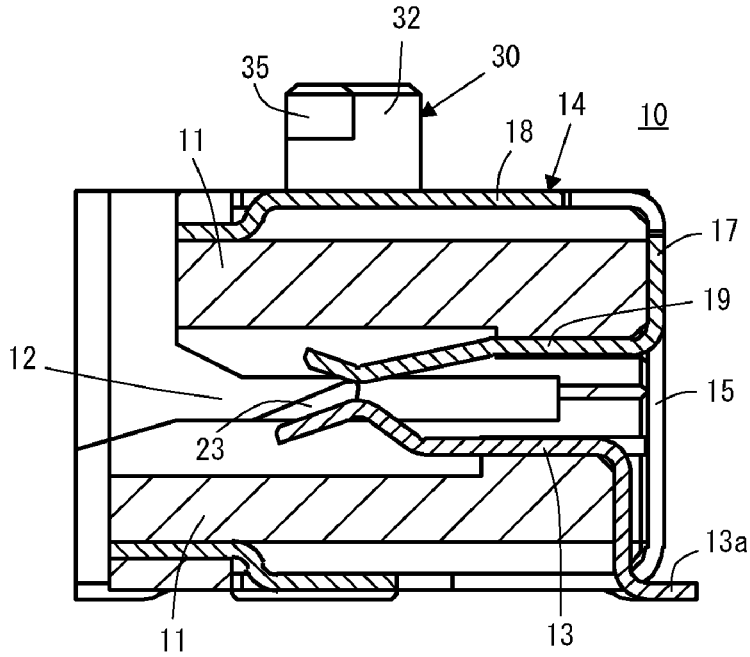
FIG. 4 is a schematic cross sectional view taken along line IV-IV on FIG. 3.

Further, the conductive shell 14 is provided with a belt-shaped plate portion 17 separated from an upper plate portion 18 of the conductive shell 14 for connecting a pair of left and right rear plate portions 15 and 16 of the conductive shell 14 with each other on the rear end portion of the housing 11. The left rear plate portion 15 of the conductive shell 14 covers a part of the rear end portion of the housing 11 on the left side of the housing 11 and the right rear plate portion 16 of the conductive shell 14 covers a part of the rear end portion of the housing 11 on the right side of the housing 11. The belt-shaped plate portion 17 is provided therein with a plurality of ground contacts 19. Each of the ground contacts 19 extends into the housing 11 toward the opening 12 formed in the front end portion of the housing 11 from the belt-shaped plate portion 17, as shown in FIG. 4 showing a cross sectional view taken along line IV-IV on FIG. 3. In the housing 11, the ground contacts 19 is positioned to be opposite to a corresponding one of the conductive contacts 13 and operative to come into press-contact with a ground connecting portion provided on the FPC when the FPC is inserted in the housing 11 through the opening 12 provided thereon.

Figure 5:
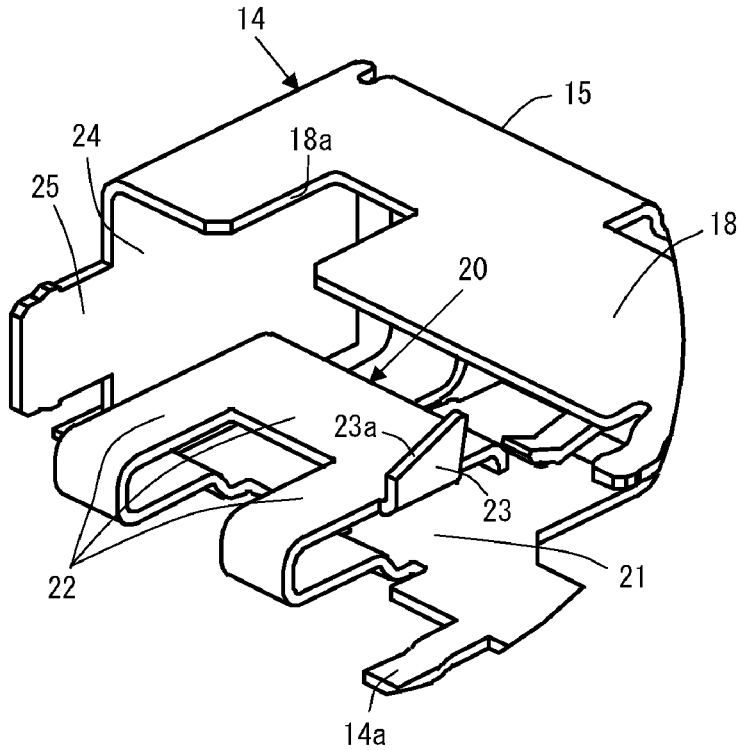
FIG. 5 is a schematic partial perspective view showing a part of a conductive shell employed in the embodiment shown in FIG. 1.

The conductive shell 14 is also provided with a holding member 20 for holding the FPC inserted in the housing 11 through the opening 12 provided thereon. As shown in FIG. 5, the holding member 20 is formed in a body in the conductive shell 14 at a position opposite to the left rear plate portion 15 of the conductive shell 14. The holding member 20 thus formed is provided with a resilient arm portion 22 forming a frame-shape structure which extends first toward the front end portion of the housing 11 and then folds back to extend toward the left rear plate portion 15 of the conductive shell 14 and an engaging portion 23 supported to be shiftable in position by the resilient arm portion 22.

The engaging portion 23 of the holding member 20 constitutes a projection standing up on the resilient arm portion 22 toward the upper plate portion 18 of the conductive shell 14. A slanted end plane 23*a* is formed on an upper end of the engaging portion 23 to ascend gradually in a direction along which the FPC is inserted into the housing 11 through the opening 12 provided thereon. The engaging portion 23 is positioned in the inside of the conductive shell 14 for engaging with an engaging edged portion provided on the FPC inserted in the housing 11, as described later.

Figure 6:
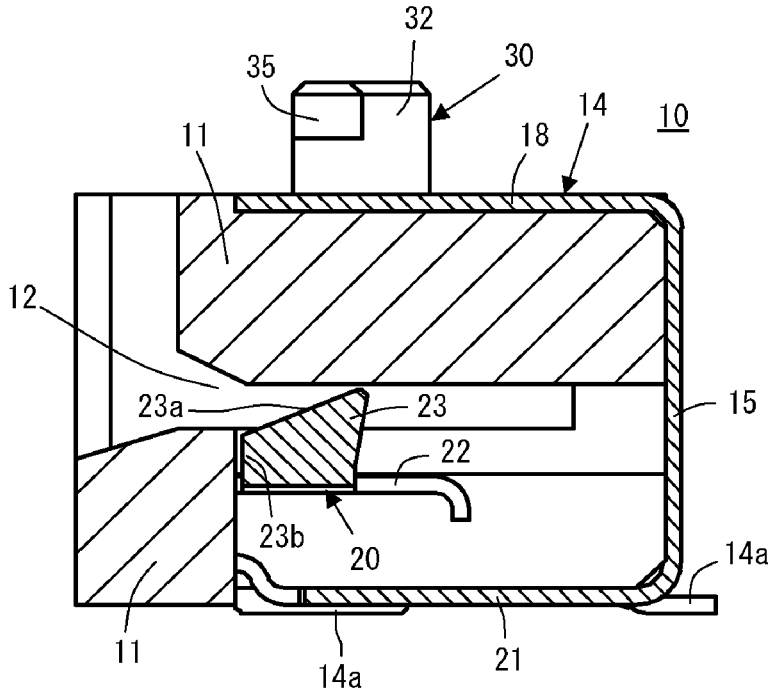
FIG. 6 is a schematic cross sectional view taken along line VI-VI on FIG. 3.

As shown in FIG. 6 showing a cross sectional view taken along line VI-VI on FIG. 3, an uppermost end of the engaging portion 23 is positioned in close vicinity to a part of the housing 11 and an end portion 23*b* of the engaging portion 23 on the side of the opening 12 on housing 11 is positioned in close vicinity to the front end portion of the housing 11 in which the opening 12 is formed.

A left side portion 24 of the conductive shell 14, which covers a left end portion of the housing 11, is provided with an engaging projection 25 operative to be inserted into a slit formed on the front end portion of the housing 11 for engaging with the housing 11.

In the housing 11, a releasing member 30 is provided to be movable at a position corresponding to the holding member 20 and operative to move for releasing the FPC inserted in the housing 11 from the holding by the holding member 20.

Figure 7:
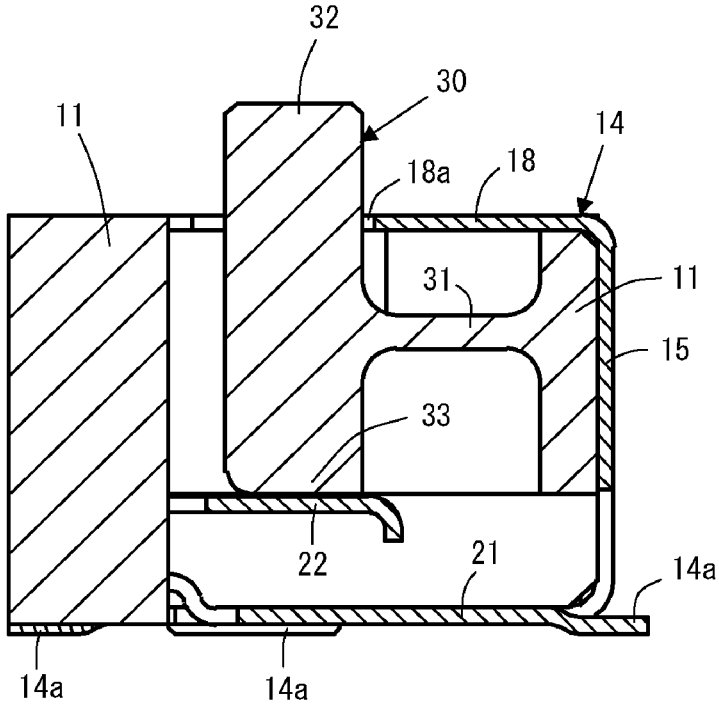
FIG. 7 is a schematic cross sectional view taken along line VII-VII on FIG. 3.

The releasing member 30 is connected through a connecting arm portion 31 with an inside face of the rear end portion of the housing 11 so as to be formed in a body in the housing 11, as shown in FIG. 7 showing a cross sectional view taken along line VII-VII on FIG. 3. The connecting arm portion 31 is resilient to be able to swing up and down in FIG. 7 when the releasing member 30 is caused in its entirety to move up and down in FIG. 7.

Figure 8:
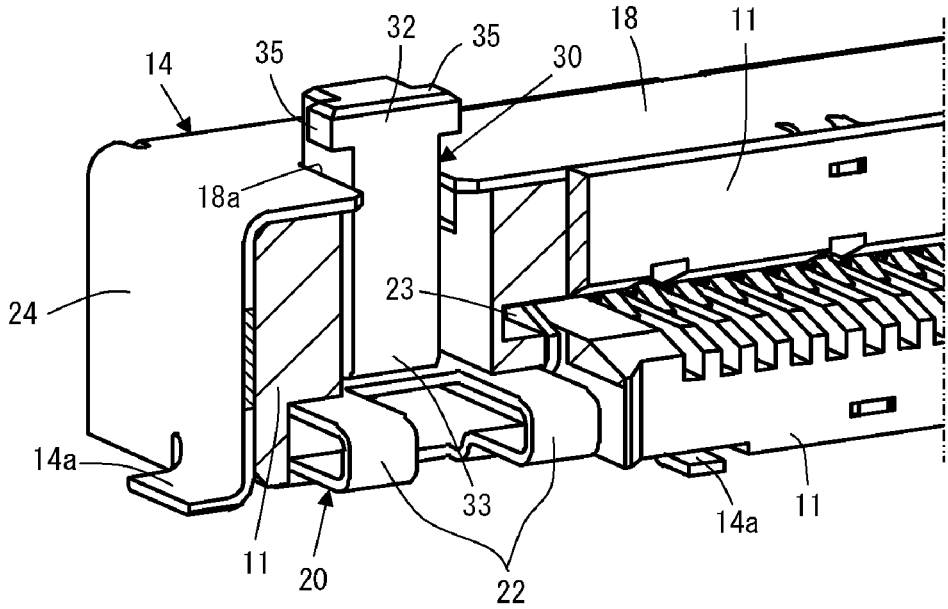
FIG. 8 is a schematic partial perspective view including a partial cross sectional view showing arrangement of a holding member and a releasing member employed in the embodiment shown in FIG. 1.

As shown also in FIG. 8, the releasing member 30 on the whole is formed in the shape of, for example, a square pillar with a pair of end portions 32 and 33 opposite each other. The end portion 32 of the releasing member 30 is operative to project from the inside to the outside of the conductive shell 14 through an opening 18*a* formed in the upper plate portion 18 of the conductive shell 14 and the end portion 33 of the releasing member 30 is operative to be in contact with the resilient arm portion 22 of the holding member 20 in the inside of the housing 11. That is, the releasing member 30 is formed in a body in the housing 11 to be movable with the end portion 33 thereof operative to be in contact with the holding member 20 formed in the conductive shell 14 and the end portion 32 thereof operative to project the inside to the outside of the conductive shell 14 on the side of the first end surface of the housing 11 opposite to the second end surface of the housing 11 which faces the solid circuit board on which the housing 11 is mounted.

Figure 10:
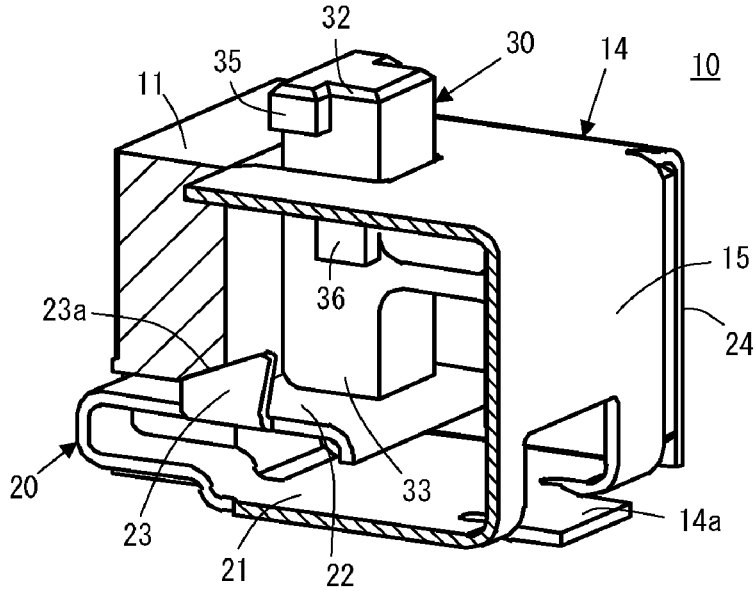
FIG. 10 is a schematic partial perspective view including a partial cross sectional view showing arrangement of the holding member and the releasing member employed in the embodiment shown in FIG. 1.

A couple of projections 35 are provided on the end portion 32 of the releasing member 30 to be positioned at the outside of the upper plate portion 18 of the conductive shell 14 for projecting along the upper plate portion 18 of the conductive shell 14. Another couple of projections 36 are also provided on the releasing member 30 to be positioned at the inside of the upper plate portion 18 of the conductive shell 14 in the same manner as the projections 35, as shown in FIG. 10 described later.

When the end portion 32 of the releasing member 30 is pushed toward the inside of the conductive shell 14, the releasing member 30 is moved in its entirely in a direction from the end portion 32 to the end portion 33 of the releasing member 30, so that the end portion 33 of the releasing member 30 causes the resilient arm portion 22 of the holding member 20 to deform resiliently. Then, when the end portion 32 of the releasing member 30 has not been pushed toward the inside of the conductive shell 14, the releasing member 30 is moved in its entirely in a direction from the end portion 33 to the end portion 32 of the releasing member 30 by the resilient arm portion 22 of the holding member 20 restoring resiliently so as to return to the original position. The releasing member 30 is limited in its movement in the direction from the end portion 32 to the end portion 33 of the releasing member 30 by the projections 35 coming into contact with the upper plate portion 18 of the conductive shell 14 from the outside thereof and further limited in its movement in the direction from the end portion 33 to the end portion 32 of the releasing member 30 by the projections 36 coming into contact with the upper plate portion 18 of the conductive shell 14 from the inside thereof.

Figure 9:
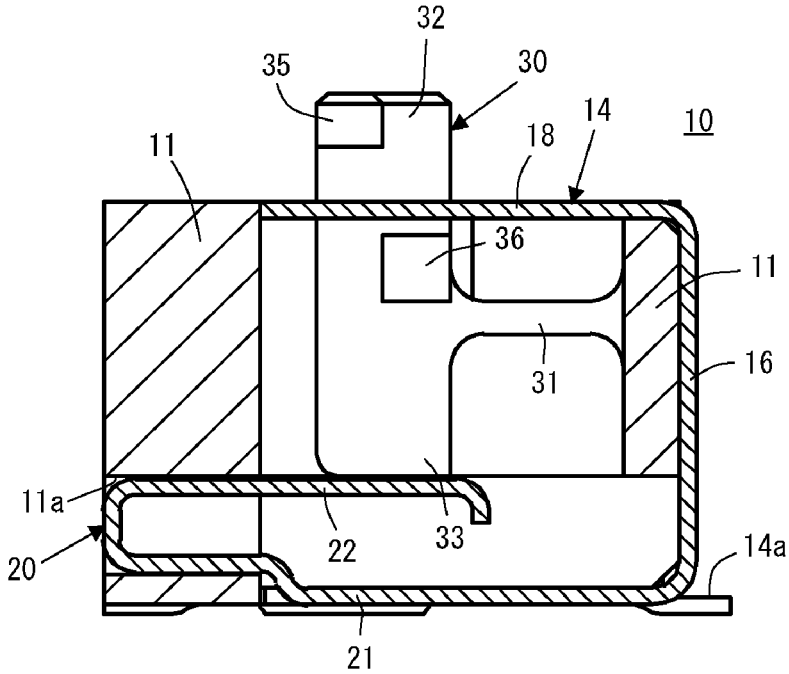
FIG. 9 is a schematic cross sectional view taken along line IX-IX on FIG. 3.

As shown in FIG. 9 showing a cross sectional view taken along line IX-IX on FIG. 3, the conductive shell 14 is further provided with another holding member 20 for holding the FPC inserted in the housing 11 through the opening 12 provided thereon at a position opposite to the right rear plate portion 16 of the conductive shell 14, in the same manner as the holding member 20 provided at the position opposite to the left rear plate portion 15 of the conductive shell 14. The holding member 20 provided at the position opposite to the right rear plate portion 16 of the conductive shell 14 is also formed in a body in the conductive shell 14 to have a resilient arm portion 22 forming a frame-shape structure which extends first toward the front end portion of the housing 11 and then folds back to extend toward the right rear plate portion 16 of the conductive shell 14 and an engaging portion 23 supported to be shiftable in position by the resilient arm portion 22. The engaging portion 23 does not appear in FIG. 9. The resilient arm portion 22 is operative to come into resilient press-contact with a part 11*a* of the housing 11.

Incidentally, in the holding member 20 provided at the position opposite to the left rear plate portion 15 of the conductive shell 14 also, the resilient arm portion 22 is operative to come into resilient press-contact with a part corresponding to the part 11*a* of the housing 11.

In addition, as shown in FIG. 9, another releasing member 30 is also provided to be movable at a position corresponding to the holding member 20 provided at the position opposite to the right rear plate portion 16 of the conductive shell 14 and operative to move for releasing the FPC inserted in the housing 11 from the holding by the holding member 20, in the same manner as the releasing member 30 provided at the position corresponding to the holding member 20 provided at the position opposite to the left rear plate portion 15 of the conductive shell 14.

The releasing member 30 provided at the position corresponding to the holding member 20 provided at the position opposite to the right rear plate portion 16 of the conductive shell 14 is also connected through a connecting arm portion 31 with the inside face of the rear end portion of the housing 11 so as to be formed in a body in the housing 11 and the connecting arm portion 31 thus provided is also resilient to be able to swing up and down in FIG. 9 when the releasing member 30 is caused in its entirety to move up and down in FIG. 9.

The releasing member 30 provided at the position corresponding to the holding member 20 provided at the position opposite to the right rear plate portion 16 of the conductive shell 14 on the whole is formed in the shape of, for example, a square pillar with a pair of end portions 32 and 33 opposite each other. The end portion 32 of the releasing member 30 is operative to project from the inside to the outside of the conductive shell 14 through the opening 18*a* formed in the upper plate portion 18 of the conductive shell 14 and the end portion 33 of the releasing member 30 is operative to be in contact with the resilient arm portion 22 of the holding member 20 in the inside of the housing 11. Further, a couple of projections 35 are provided on the end portion 32 of the releasing member 30 to be positioned at the outside of the upper plate portion 18 of the conductive shell 14 for projecting along the upper plate portion 18 of the conductive shell 14 and another couple of projections 36 are also provided on the releasing member 30 to be positioned at the inside of the upper plate portion 18 of the conductive shell 14 in the same manner as the projections 35. (In FIG. 9, only one of the projections 35 and one of the projections 36 appear.)

When the end portion 32 of the releasing member 30 provided at the position corresponding to the holding member 20 provided at the position opposite to the right rear plate portion 16 of the conductive shell 14 is pushed toward the inside of the conductive shell 14, the releasing member 30 is moved in its entirely in a direction from the end portion 32 to the end portion 33 of the releasing member 30, so that the end portion 33 of the releasing member 30 causes the resilient arm portion 22 of the holding member 20 to deform resiliently. Then, when the end portion 32 of the releasing member 30 provided at the position corresponding to the holding member 20 provided at the position opposite to the right rear plate portion 16 of the conductive shell 14 has not been pushed toward the inside of the conductive shell 14, the releasing member 30 is moved in its entirely in a direction from the end portion 33 to the end portion 32 of the releasing member 30 by the resilient arm portion 22 of the holding member 20 restoring resiliently so as to return to the original position. The releasing member 30 provided at the position corresponding to the holding member 20 provided at the position opposite to the right rear plate portion 16 of the conductive shell 14 is also limited in its movement in the direction from the end portion 32 to the end portion 33 of the releasing member 30 by the projections 35 coming into contact with the upper plate portion 18 of the conductive shell 14 from the outside thereof and further limited in its movement in the direction from the end portion 33 to the end portion 32 of the releasing member 30 by the projections 36 coming into contact with the upper plate portion 18 of the conductive shell 14 from the inside thereof.

As described above, the electrical connector 10 is provided at both end portions thereof in the longitudinal direction of each of the housing 11 and the conductive shell 14 with a couple of holding members 20 and a couple of releasing members 30.

Figure 11:
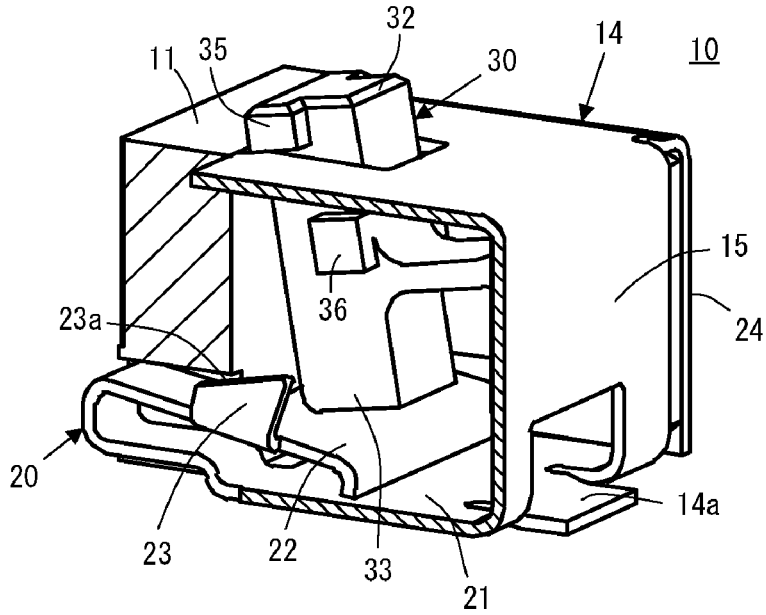
FIG. 11 is a schematic partial perspective view including a partial cross sectional view showing arrangement of the holding member and the releasing member employed in the embodiment shown in FIG. 1.

Each of FIGS. 10 and 11 shows a positional relation between the holding member 20 and the releasing member 30 both provided at the left end portion of the housing 11 of the electrical connector 10.

Referring to FIG. 10, the end portion 32 of the releasing member 30 is not pushed toward the inside on the conductive shell 14. Accordingly, the end portion 33 of the releasing member 30 is in contact with the resilient arm portion 22 of the holding member 20 so as not to push the same toward the lower plate portion 21 of the conductive shell 14 and therefore the resilient arm portion 22 of the holding member 20 is put in a condition not to deform resiliently.

On the other hand, referring to FIG. 11, the end portion 32 of the releasing member 30 is pushed toward the inside on the conductive shell 14 so that the releasing member 30 is moved in its entirety in the direction from the end portion 32 to the end portion 33. Accordingly, the end portion 33 of the releasing member 30 is put in a condition to push the resilient arm portion 22 of the holding member 20 toward a lower plate portion 21 of the conductive shell 14 so as to cause the resilient arm portion 22 of the holding member 20 to deform resiliently. The engaging portion 23 supported by the resilient arm portion 22 of the holding member 20 is shifted in position to approach the lower plate portion 21 of the conductive shell 14 from the position thereof shown in FIG. 10.

As for the holding member 20 and the releasing member 30 both provided at the right end portion of the housing 11 of the electrical connector 10, the positional relations between the holding member 20 and the releasing member 30 are the same as those mentioned above.

Figure 12:
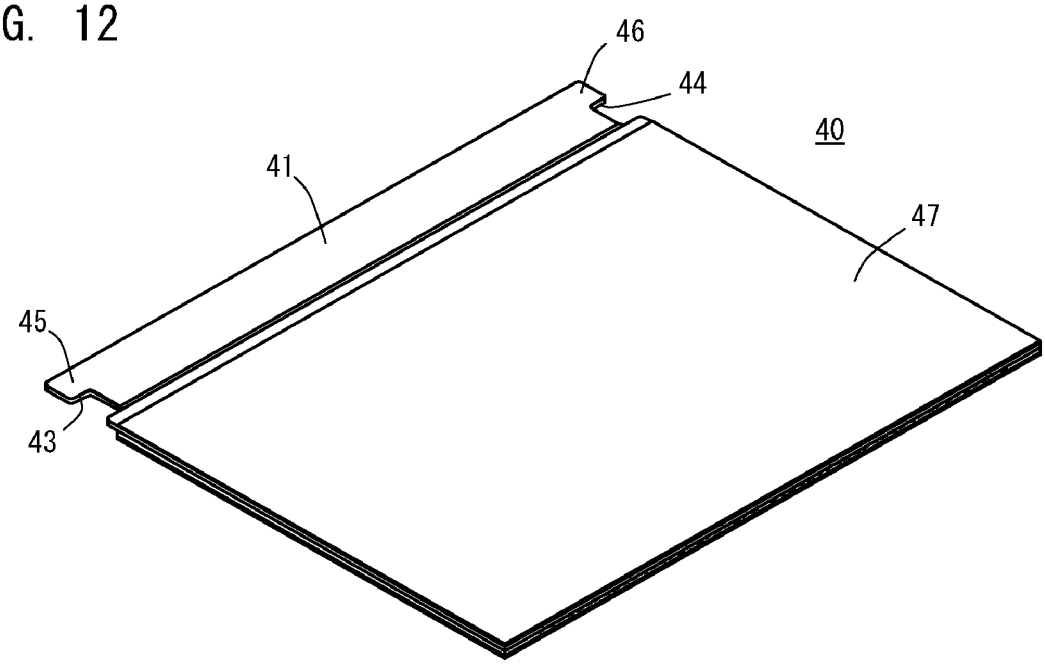
FIG. 12 is a schematic rear, top and left side perspective view showing an FPC which is to be inserted into a housing of the embodiment shown in FIG. 1.
Figure 13:
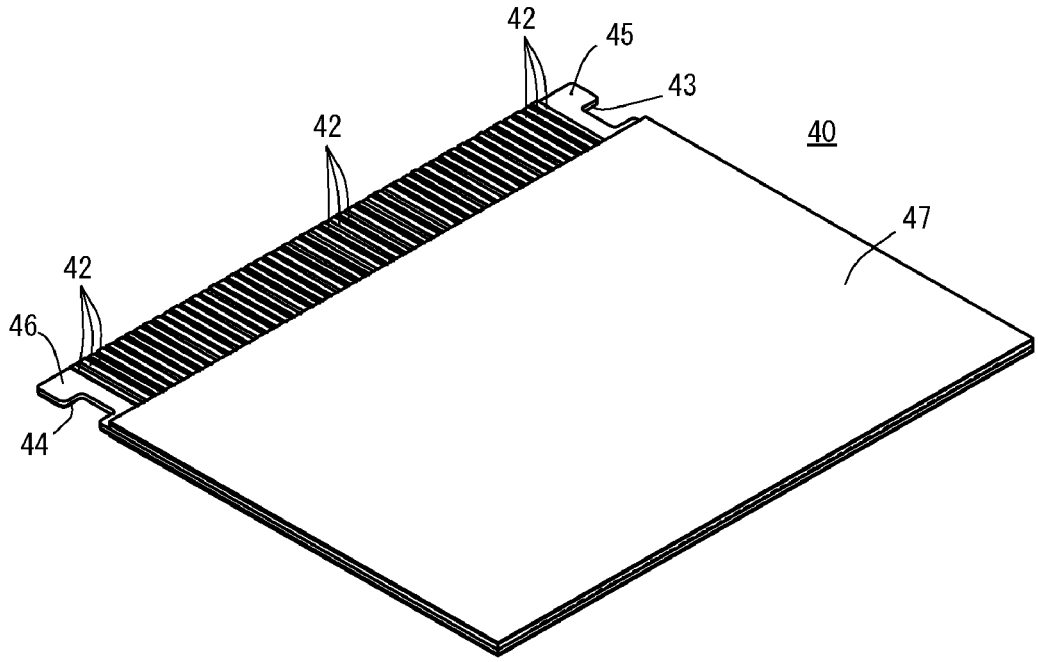
FIG. 13 is a schematic rear, bottom and left side perspective view showing an FPC which is to be inserted into a housing of the embodiment shown in FIG. 1.

Each of FIGS. 12 and 13 shows an FPC 40 which is an example of the FPC constituting the flat circuit device to be inserted into the housing 11 of the electrical connector 10 through the opening 12 provided on the housing 11.

Referring to FIGS. 12 and 13, a ground connecting portion 41 is provided on an end portion of a front surface of the FPC 40 shown in FIG. 12 and a plurality of signal connecting terminals 42 each made of conductive material and formed into a rectangular plate member are provided to be arranged on an end portion of a reverse surface of the FPC 40 shown in FIG. 13. Further, a pair of engaging edged recesses 43 and 44 are provided respectively on side end portions of the FPC 40 which are opposite each other with the signal connecting terminals 42 on the reverse surface of the FPC 40 between. A top flat portion 45 is formed at the outside of the engaging edged recesses 43 provided on one of the side end portions of the FPC 40 and another top flat portion 46 is formed at the outside of the engaging edged recesses 44 provided on the other of the side end portions of the FPC 40.

It is possible to provide the FPC 40 with a pair of engaging edged holes in place of the engaging edged recesses 43 and 44. The FPC 40 is covered with a coating film 47 except portions thereof on which the ground connecting portion 41, the signal connecting terminals 42 and the engaging edged recesses 43 and 44 are provided.

Figure 14:
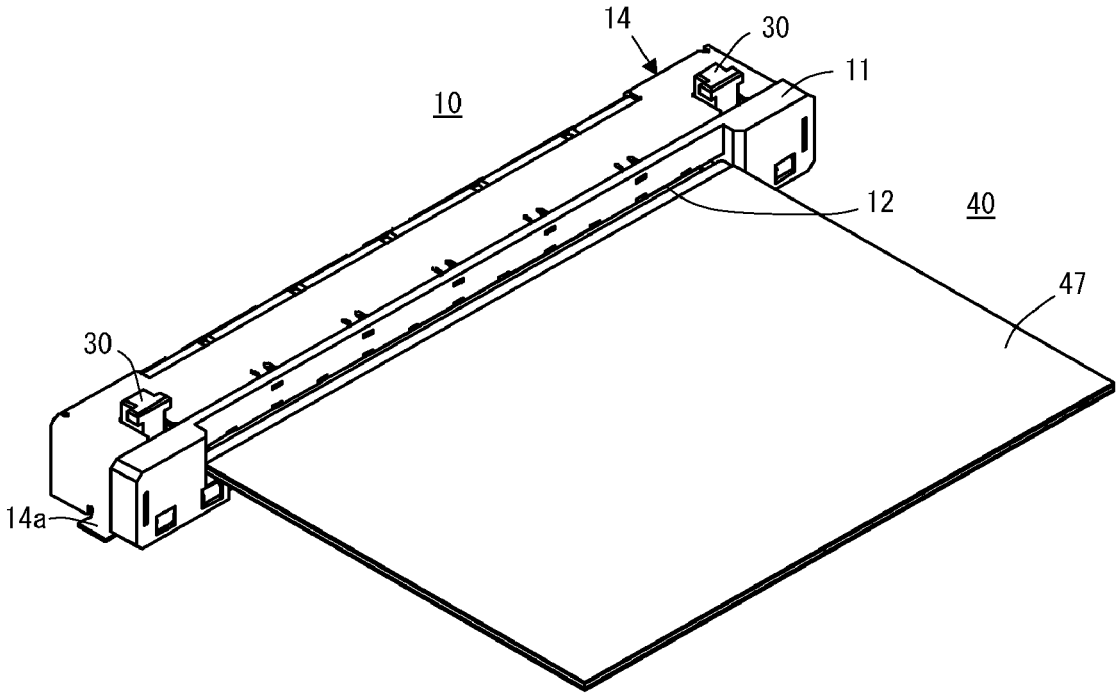
FIG. 14 is a schematic perspective view showing the embodiment shown in FIG. 1 and the FPC which is inserted in the housing of the embodiment.

FIG. 14 shows the electrical connector 10 and the FPC 40 which is inserted in the housing 11 of the electrical connector 10 through the opening 12 provided on the housing 11. In FIG. 14, the front surface of the FPC 40, on which the ground connecting portion 41 is provided and which is covered with the coating film 47, is shown.

Figure 15:
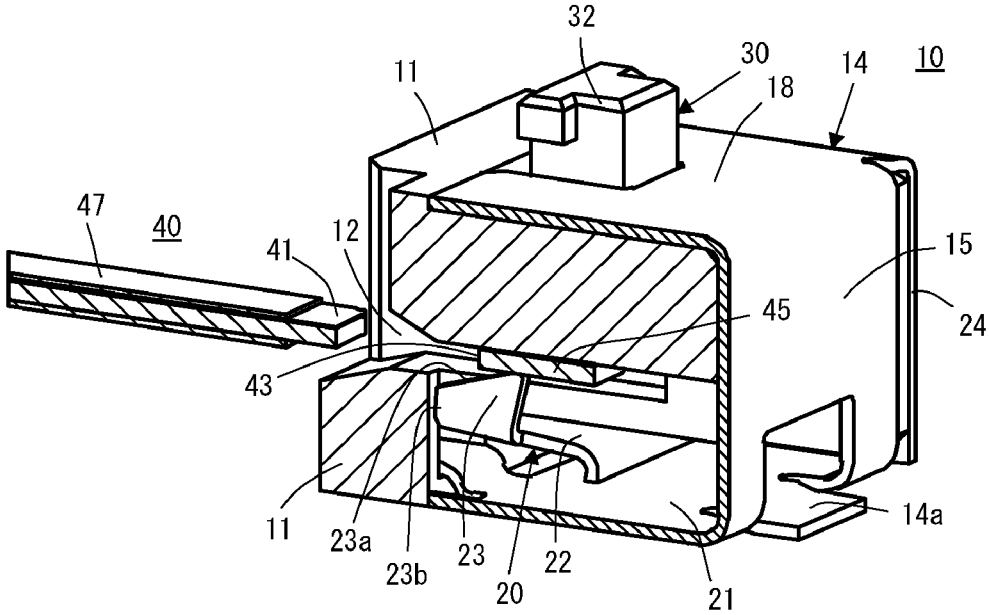
FIG. 15 is a schematic partial perspective view including a partial cross sectional view for showing the embodiment shown in FIG. 1 and the FPC which is put on the way to be inserted into the housing of the embodiment.

When the FPC 40 is inserted into the housing 11 of the electrical connector 10 through the opening 12 provided on the housing 11, as shown in FIG. 14, first the upper end of the engaging portion 23 of the holding member 20, on which the slanted end plane 23*a* in formed, comes into contact with the top flat portion 45 formed on the FPC 40 on the side of the lower plate portion 21 of the conductive shell 14 at the left end portion of the housing 11, as shown in FIG. 15. At this time, the engaging portion 23 of the holding member 20 is pushed toward the lower plate portion 21 of the conductive shell 14 by the top flat portion 45 formed on the FPC 40 and thereby the resilient arm portion 22 of the holding member 20 is resiliently deformed so as to shift the engaging portion 23 of the holding member 20 in its position to approach the lower plate portion 21 of the conductive shell 14.

In addition, although illustrations are omitted, at the right end portion of the housing 11 also, the upper end of the engaging portion 23 of the holding member 20, on which the slanted end plane 23*a* in formed, comes into contact with the top flat portion 46 formed on the FPC 40 on the side of the lower plate portion 21 of the conductive shell 14 at the left end portion of the housing 11. At this time, the engaging portion 23 of the holding member 20 is pushed toward the lower plate portion 21 of the conductive shell 14 by the top flat portion 46 formed on the FPC 40 and thereby the resilient arm portion 22 of the holding member 20 is resiliently deformed so as to shift the engaging portion 23 of the holding member 20 in its position to approach the lower plate portion 21 of the conductive shell 14.

Figure 16:
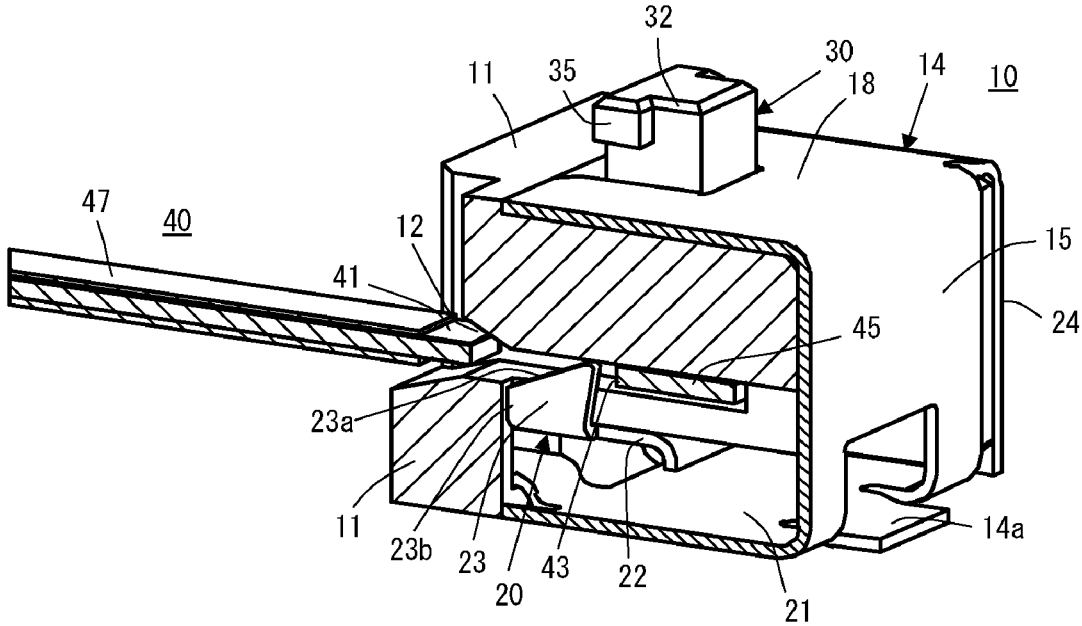
FIG. 16 is a schematic partial perspective view including a partial cross sectional view for showing the embodiment shown in FIG. 1 and the FPC which has been inserted in the housing of the embodiment and held by a holding member provided in the housing.

Then, the FPC 40 is further inserted into the housing 11 to reach a predetermined appropriate position in the housing 11. When the FPC 40 has reached the appropriate position in the housing 11, the upper end of the engaging portion 23 of the holding member 20, on which the slanted end plane 23*a* in formed, is put out of the top flat portion 45 formed on the FPC 40 and shifted in its position by the resilient arm portion 22 of the holding member 20 restoring resiliently to go away from the lower plate portion 21 of the conductive shell 14, so that the engaging portion 23 of the holding member 20 engages with the engaging edged recess 43 provided on the FPC 40 for holding the FPC 40, at the left end portion of the housing 11, as shown in FIG. 16.

In addition, although illustrations are omitted, at the right end portion of the housing 11 also, the upper end of the engaging portion 23 of the holding member 20, on which the slanted end plane 23*a* in formed, is put out of the top flat portion 46 formed on the FPC 40 and shifted in its position by the resilient arm portion 22 of the holding member 20 restoring resiliently to go away from the lower plate portion 21 of the conductive shell 14, so that the engaging portion 23 of the holding member 20 engages with the engaging edged recess 44 provided on the FPC 40 for holding the FPC 40.

On that occasion, the FPC 40 inserted in the housing 11 has reached the predetermined appropriate position in the housing 11 and held by the couple of the holding members 20 provided respectively at the left and right end portions of the housing 11 so as to be prevented from getting out from the housing 11 unwillingly. This results in that the FPC 40 is automatically put in a condition to be prevented from getting out from the housing 11 unwillingly only by means of being inserted into the housing 11.

When the FPC 40 inserted in the housing 11 has reached the predetermined appropriate position in the housing 11, the upper end of the engaging portion 23 of the holding member 20 is put out of each of the top flat portions 45 and 46 formed on the FPC 40 and thereby the resilient arm portion 22 of the holding member 20 is restored to its condition prior to resilient deformation so as to hit with resilient force against the portion 11*a* of the housing 11 shown in FIG. 9. As a result, a click of hitting is made when the resilient arm portion 22 of the holding member 20 hits with resilient force against the portion 11*a* of the housing 11. Accordingly, the engagement of the engaging portion 23 of the holding member 20 with each of the engaging edged recesses 43 and 44 provided on the FPC 40 which has reached the predetermined appropriate position in the housing 11 can be easily confirmed by means of aural check from the outside of the conductive shell 14.

Under a condition wherein the FPC 40 inserted in the housing 11 takes up the predetermined appropriate position in the housing 11 in the manner described above, each of the ground contacts 19 extending into the housing 11 from the belt-shaped plate portion 17 of the conductive shell 14 comes into resilient press-contact with the ground connecting portion 41 on the front surface of the FPC 40 from the side of the upper plate portion 18 of the conductive shell 14. As a result, the ground connecting portion 41 on the front surface of the FPC 40 inserted in the housing 11 is electrically connected through the ground contacts 19 with the grounded portion provided on the solid circuit board on which the housing 11 is mounted.

Further, each of the conductive contacts 13 arranged on the housing 11 also comes into resilient press-contact with a corresponding one of the signal connecting terminals 42 on the reverse surface of the FPC 40 from the side of the lower plate portion 21 of the conductive shell 14. As a result, the signal connecting terminals 42 on the reverse surface of the FPC 40 inserted in the housing 11 are electrically connected through the conductive contacts 13 with the circuit terminals provided on the solid circuit board on which the housing 11 is mounted.

When the FPC 40 inserted in the housing 11, which is put in such a condition as taking up the predetermined appropriate position in the housing 11 to be held by the holding members 20, is pulled in a direction from the inside to the outside of the housing 11 and thereby the engaging edged recesses 43 and 44 provided on the FPC 40 push respectively the engaging portions 23 of the holding members 20 toward the opening 12 provided on the housing 11, the end portion 23*b* of each of the engaging portions 23 of the holding members 20, which is positioned in close vicinity to the front end portion of the housing 11 in which the opening 12 is formed, comes into press-contact with the front end portion of the housing 11 and thereby each of the engaging portions 23 of the holding members 20 pushed respectively by the engaging edged recesses 43 and 44 provided on the FPC 40 is stopped by the front end portion of the housing 11 in which the opening 12 is formed. As a result, each of the engaging portions 23 of the holding members 20 pushed respectively by the engaging edged recesses 43 and 44 provided on the FPC 40 does not exert substantially any harmful force to the resilient arm portion 22 of the holding member 20 supporting the engaging portion 23, so that each of the resilient arm portions 22 of the holding members 20 is prevented from deforming undesirably.

Figure 17:
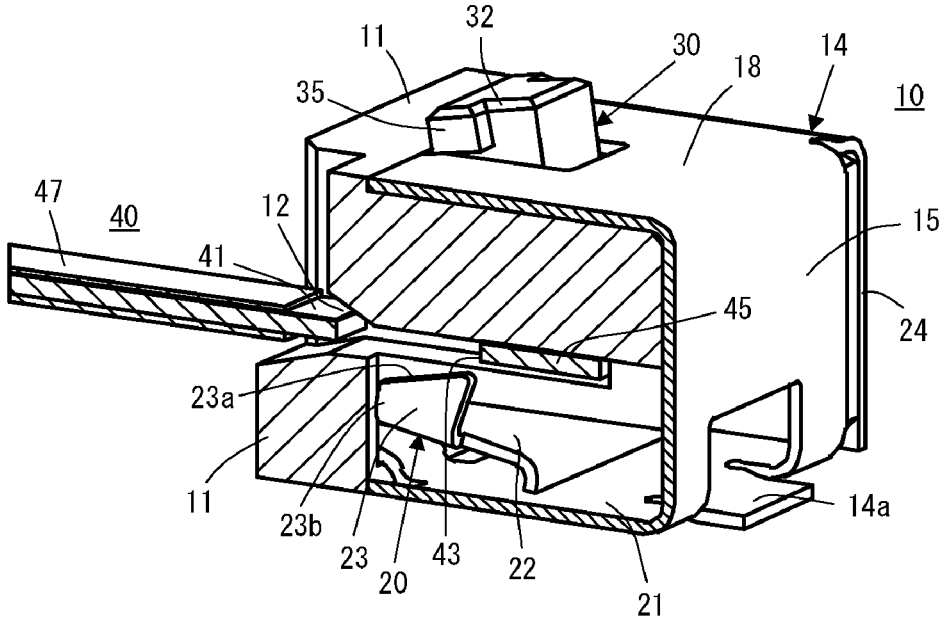
FIG. 17 is a schematic partial perspective view including a partial cross sectional view for showing the embodiment shown in FIG. 1 and the FPC which is released from holding by the holding member provided in the housing of the embodiment.

After that, when the end portion 32 of the releasing member 30 is pushed toward the inside of the conductive shell 14 at each of the left and right end portions of the housing 11, as shown in FIG. 17, the releasing member 30 is moved in its entirely toward the lower plate portion 21 of the conductive shell 14 to be inclined for causing the connecting arm portion 31 extending from the inside face of the rear end portion of the housing 11 to swing down resiliently. Thereby, the end portion 33 of the releasing member 30 causes the resilient arm portion 22 of the holding member 20 to deform resiliently so as to move to approach the lower plate portion 21 of the conductive shell 14.

The resilient arm portion 22 of the holding member 20 moved to approach the lower plate portion 21 of the conductive shell 14 causes the engaging portion 23 of the holding member 20, which is supported by the resilient arm portion 22, to shift in its position to approach the lower plate portion 21 of the conductive shell 14. As a result, the engaging portion 23 of the holding member 20 is released from the engagement with each of the engaging edged recesses 43 and 44 provided on the FPC 40 and thereby the FPC 40 inserted in the housing 11 is put in a condition to be able to get out of the housing 11 appropriately.

In the case where the engaging edged holes are provided on the FPC 40 in place of the engaging edged recesses 43 and 44, the FPC 40 inserted in the housing 11 is also held by the holding members 20 and then released from the holding by the holding members 20 in the same manner as mentioned above.

With the electrical connector 10 constituting the embodiment of electrical connector according to the present invention as described above, when the FPC 40 is inserted into the housing 11 thorough the opening 12 provided thereon, such a condition that the ground connecting portion 41 on the front surface of the FPC 40 inserted in the housing 11 is electrically connected through the ground contacts 19 with the grounded portion provided on the solid circuit board on which the housing 11 is mounted, the signal connecting terminals 42 on the reverse surface of the FPC 40 inserted in the housing 11 are electrically connected through the conducting contacts 13 arranged on the housing 11 with the circuit terminals provided on the solid circuit board on which the housing 11 is mounted, and the holding members 20 provided respectively at the left and right end portions of the housing 11 engages with the FPC 40 inserted in the housing 11 to hold appropriately the same, can be obtained automatically.

Further, it is not required, for causing the holding members 20 formed in the conductive shell 14 to be put in engagement with the FPC 40 inserted in the housing 11 to hold the same and then to be released by the releasing members 30 provided in the housing 11 from the engagement with the FPC 40 to put the same in free, to provide on the housing 11 an actuator rotatable in regard to the housing 11 or the like or to set the conductive shell 14 to be rotatable in regard to the housing 11. Accordingly, the conductive shell 14 fixed to the housing 11 can be used for fastening the housing 11 to the solid circuit board on which the housing 11 is mounted and any additional member for fastening the housing 11 to the solid circuit board is not required. As a result, the electrical connector 10 can be constituted with a relatively small number of constitutive parts and at a production cost reduced effectively.

In addition, since each of the holding members 20 is released from the engagement with the FPC 40 inserted in the housing 11 when the end portion 32 of each of the releasing members 30, which projects from the inside to the outside of the conductive shell 14, is pushed toward the inside of the conductive shell 14, each of the holding members 20 can be released from the engagement with the FPC 40 inserted in the housing 11 by extremely simple and easy operations and it is not necessary for carrying out such operations to provide an undesirable open space around each of the releasing members 30.

Besides, since the conductive shell 14 provided with the holding members 20 formed therein is mounted on the housing 11 to cover a major part of the same and connected electrically with the grounded portion provided on the solid circuit board on which the housing 11 is mounted, the conductive shell 14 can be operative to contribute effectively to the adjustment on the characteristic impedance of each of the conductive contacts 13 arranged on the housing 11 and to shield sufficiently the conductive contacts 13 in the housing 11 from electromagnetic wave noises from the outside.

Going into details of the electrical connector 10 thus constituted, since the end portion 33 of each of the releasing members 30 is operative to deform resiliently the resilient arm portion 22 of the holding member 20 to shift the engaging portion 23 of the holding member 20 in its position so that the engaging portion 23 of the holding member 20 is released from the engagement with the engaging edged recess 43 or 44 provided on the FPC 40 inserted in the housing 11 when the end portion 32 of each of the releasing members 30 is pushed toward the inside of the conductive shell 14 under the condition wherein the engaging portion 23 of each of the holding members 20 supported to be shiftable in its position by the resilient arm portion 22 of the holding members 20 is put in engagement with each of the engaging edged recesses 43 and 44 provided on the FPC 40 inserted in the housing 11, the FPC 40 inserted in the housing 11 can be easily put in holding by the holding members 20 and then surely released from the holding by the holding members 20.

What is claimed is:

1. An electrical connector comprising;

a housing made of insulator to be mounted on a solid circuit board and provided thereon with an opening through which a flat circuit device is inserted into the housing, a plurality of conductive contacts arranged on the housing to be electrically connected respectively with circuit terminals provided on the solid circuit board and positioned to correspond respectively to connecting terminals provided on the flat circuit device when the flat circuit device is inserted in the housing through the opening provided thereon, a conductive shell mounted on the housing to cover a major part of the same and to be electrically connected with a grounded portion provided on the solid circuit board and provided with a holding member formed in a body therein to extend into the housing for engaging with the flat circuit device inserted in the housing to hold the same, and a releasing member formed in a body in the housing to be movable with a first end portion thereof operative to be in contact with the holding member and a second end portion thereof operative to project from the inside to the outside of the conductive shell on the side of a first end surface of the housing opposite to a second end surface of the housing which faces the solid circuit board, wherein the releasing member is moved so that the first end portion of the releasing member causes the holding member to be released from engagement with the flat circuit device inserted in the housing when the second end portion of the releasing member is pushed toward the inside of the conductive shell under a condition wherein the holding member is put in the engagement with the flat circuit device to hold the same in the housing.

2. An electrical connector according to claim 1, wherein the holding member is provided with an engaging portion for engaging with an engaging edged portion provided on the flat circuit device inserted in the housing to hold the flat circuit device in the housing and a resilient arm portion for supporting the engaging portion to be shiftable in its position in the housing, and the first end portion of the releasing member is operative to be in contact with the resilient arm portion of the holding member.

3. An electrical connector according to claim 2, wherein the first end portion of the releasing member is operative to deform resiliently the resilient arm portion of the holding member to shift the engaging portion of the holding member in its position so that the engaging portion of the holding member is released from the engagement with the engaging edged portion provided on the flat circuit device inserted in the housing when the second end portion of the releasing member is pushed toward the inside of the conductive shell under a condition wherein the engaging portion of the holding member is put in engagement with the engaging edged portion provided on the flat circuit device inserted in the housing.

4. An electrical connector according to claim 2, wherein the resilient arm portion of the holding member is operative to hit with resilient force against a portion of the housing when the engaging portion of the holding member comes to the engagement with the engaging edged portion provided on the flat circuit device inserted in the housing.

5. An electrical connector according to claim 2, wherein the engaging portion of the holding member has an upper end thereof on which a slanted end plane is formed to ascend gradually in a direction along which the flat circuit device is inserted into the housing 11 through the opening provided thereon and the upper end of the engaging portion of the holding member is operative to engage with the engaging edged portion provided on the flat circuit device inserted in the housing.

6. An electrical connector according to claim 2, wherein an end portion of the engaging portion of the holding member on the side of the opening provided on the housing is positioned in close vicinity to a portion of the housing in which the opening is formed.

7. An electrical connector according to claim 1, wherein a first projection is provided on the second end portion of the releasing member to be positioned at the outside of the conductive shell for coming into contact with the conductive shell from the outside thereof.

8. An electrical connector according to claim 1, wherein a second projection is provided on the second end portion of the releasing member to be positioned at the inside of the conductive shell for coming into contact with the conductive shell from the inside thereof.

9. An electrical connector according to claim 1, wherein the releasing member is provided at each of end portions of the housing opposite each other in a direction along which the conductive contacts are arranged and the holding member is provided at each of end portions of the conductive shell opposite each other to correspond to the end portions of the housing.

10. An electrical connector according to claim 1, wherein the conductive shell is provided, in addition to the holding member, with a ground connecting portion operative to be connected electrically with the grounded portion provided on the solid circuit board on which the housing is mounted.

* * * * *